US008276914B2

(12) United States Patent
Tsai

(10) Patent No.: US 8,276,914 B2
(45) Date of Patent: Oct. 2, 2012

(54) DOLL OF FOOTBALL GAME TABLE

(76) Inventor: Jerry Tsai, Taichung (TW)

( * ) Notice: Subject to any disclaimer, the term of this patent is extended or adjusted under 35 U.S.C. 154(b) by 399 days.

(21) Appl. No.: 12/783,026

(22) Filed: May 19, 2010

(65) Prior Publication Data

US 2010/0225055 A1 Sep. 9, 2010

Related U.S. Application Data

(63) Continuation-in-part of application No. 11/968,179, filed on Jan. 1, 2008, now abandoned.

(51) Int. Cl.
*A63F 7/07* (2006.01)

(52) U.S. Cl. ..... 273/108.52; 273/106.1; 273/106.54; 446/298

(58) Field of Classification Search ..... 446/298; 273/108.1, 108.52, 108.54
See application file for complete search history.

(56) References Cited

U.S. PATENT DOCUMENTS 968,177 A * 8/1910 Merrin ..... 40/580
4,025,073 A * 5/1977 Furr et al. ..... 273/108.52
4,138,110 A * 2/1979 Hendrickson ..... 273/108.52
5,137,276 A * 8/1992 Monneret ..... 273/108.52
5,377,981 A * 1/1995 Monneret ..... 273/108.52
5,419,555 A * 5/1995 McCloud ..... 273/108.52
6,231,046 B1 * 5/2001 Tien ..... 273/108.52
6,299,163 B1 * 10/2001 Chen ..... 273/108.52
6,446,963 B1 * 9/2002 Dadbeh ..... 273/108.52
2008/0164653 A1 * 7/2008 Mercier ..... 273/108.52

* cited by examiner

*Primary Examiner* — Gene Kim
*Assistant Examiner* — Joseph B Baldori
(74) *Attorney, Agent, or Firm* — Ming Chow; Sinorica, LLC

(57) ABSTRACT

A doll of football game table for mounting on an operation rod of the football game table is disclosed. The doll includes a first main body and a second main body. Bottom ends of the two main bodies are detachably latched with each other. A connecting member detachably connects top ends of the main bodies. Accordingly, the main bodies are detachably mounted on the operation rod. The doll further includes at least one fixing member for engaging at least one of the main bodies with the operation rod. By means of operating the operation rod, the doll can be driven to move or rotate. The doll can be directly mounted on or taken off from the operation rod. In case of damage of the doll, the main bodies of the doll can be unlatched from each other to take off the doll from the operation rod so that the doll can be easily replaced.

19 Claims, 7 Drawing Sheets

DOLL OF FOOTBALL GAME TABLE

This application is a Continuation-in-Part of application Ser. No. 11/968,179, entitled DOLL OF FOOTBALL GAME TABLE, filed on Jan. 1, 2008 now abandoned.

FIELD OF THE INVENTION

The present invention is related to a game apparatus, and more particularly to a doll of a football game table detachably mounted on an operation rod of the football game table. The doll can be easily installed on or taken off from the operation rod.

BACKGROUND OF THE INVENTION

FIG. 1 shows a conventional football game table 10. Several operation rods 14 are mounted through two long sides of the table body 12. A certain number of dolls 16 are fitted on each operation rod. By means of the operation rods, the dolls 16 can be moved and rotated to drive a ball on the table body.

The conventional doll 16 is a one-piece doll having a through hole 17. When assembled, the operation rod 14 is fitted through the through hole 17 and the doll 16 is fixed on the operation rod by means of a screw 18. Such doll must be assembled with the operation rod 14 by the manufacturer before released from the factory. Once the doll is damaged, it is quite inconvenient to replace the doll. That is, it is necessary to first detach the operation rod 14 from the table body 12 and then take off the damaged doll 16 from the operation rod 14 and replace the doll with a new one. After replaced, the operation rod is reinstalled on the table body. In general, a player lacks suitable tool or component to disassemble the operation rod and replace the doll. Even if the player is able to disassemble the operation rod, it is quite troublesome and time-consuming for the player to replace the doll.

In addition, the screw 18 for fixing the doll is exposed to outer side of the doll. This affects the appearance of the entire game table.

SUMMARY OF THE INVENTION

It is therefore a primary object of the present invention to provide a doll of football game table which can be easily installed and disassembled.

It is a further object of the present invention to provide the above doll of football game table which has a tidy appearance.

The doll of football game table of the present invention includes a first main body, a second main body, a fixing member and a connecting member. The second main body defines an insertion hole and a guiding notch, where the guiding notch starts from the insertion hole, and extends downwardly and tilts at an inclined angle toward the second recess. The fixing member passes through the operation rod for holding the operation rod, and defines an end secured to the first main body and the other end abutting against the guiding notch. Until the other end of the fixing member approaches the insertion hole for inserting the fixing member, the second main body mates with the first main body. Bottom ends of the two main bodies are detachably latched with each other. The connecting member detachably connects top ends of the main bodies. Accordingly, the main bodies can be detachably mounted on an operation rod. The fixing member serves to engage at the main bodies with the operation rod. As a result, the doll can be easily mounted on the operation rod, and the main bodies of the doll can be directly unlatched from each other to take off the doll from the operation rod. Therefore, when installing or disassembling the doll, it is unnecessary to disassemble the operation rod from the football game table.

Preferably, the fixing member is hidden in the doll without being exposed to outer side so that the doll has a beautiful tidy appearance.

The present invention can be best understood through the following description and accompanying drawings wherein:

DETAILED DESCRIPTION OF THE PREFERRED EMBODIMENTS

Figure 1:
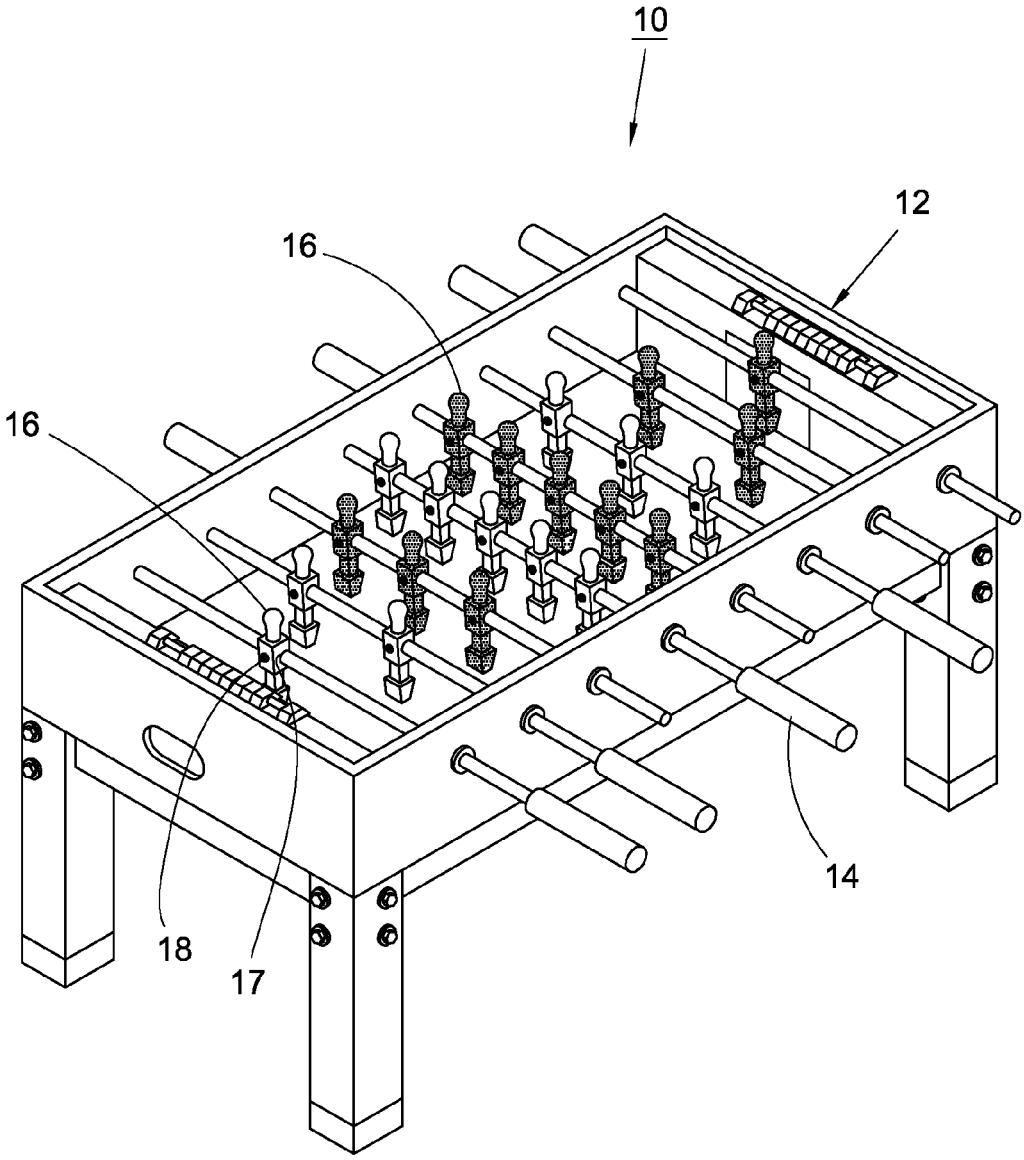
Fig. 1 PRIOR ART
FIG. 1 is a perspective view of a football game table having conventional dolls mounted on operation rods.
Figure 2:
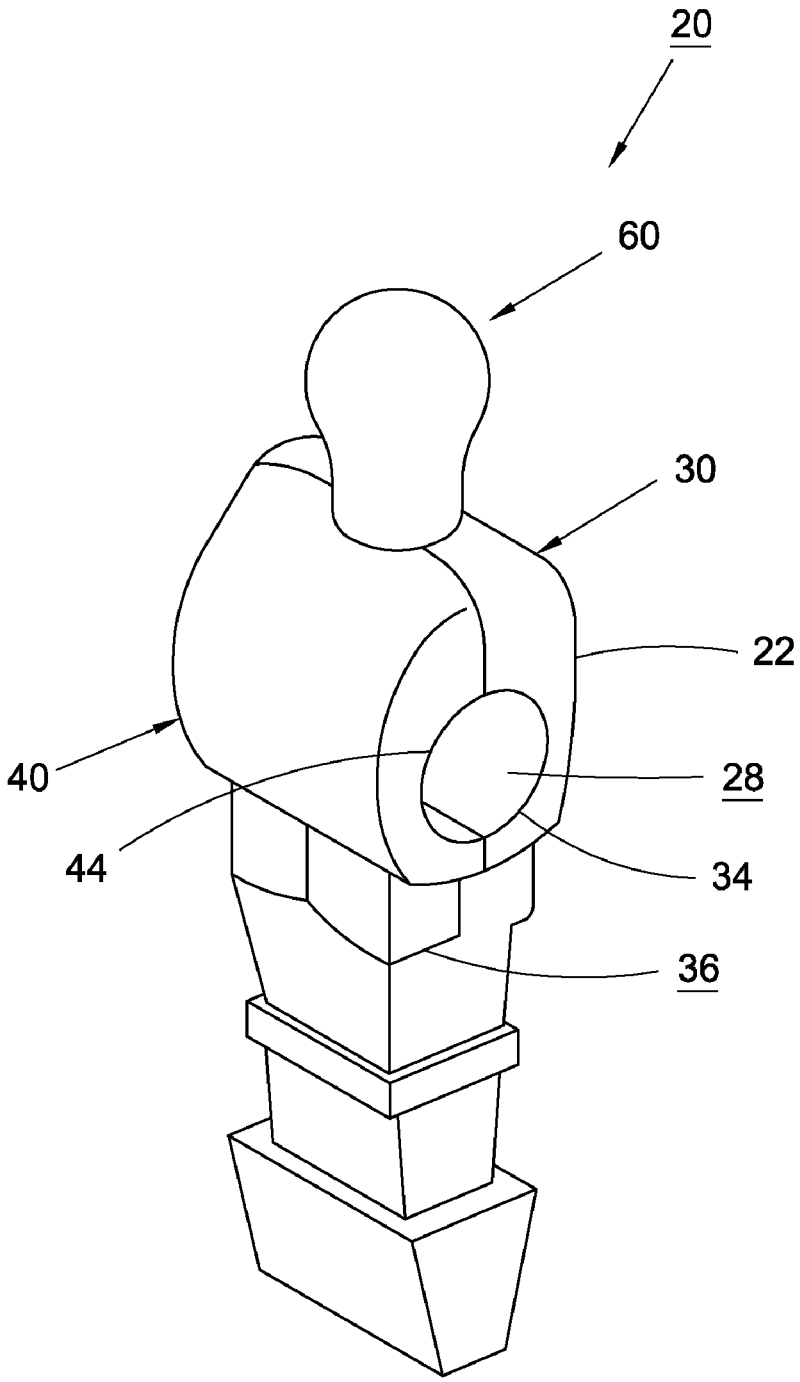
FIG. 2 is a perspective assembled view of a first embodiment of the doll of the present invention.
Figure 3:
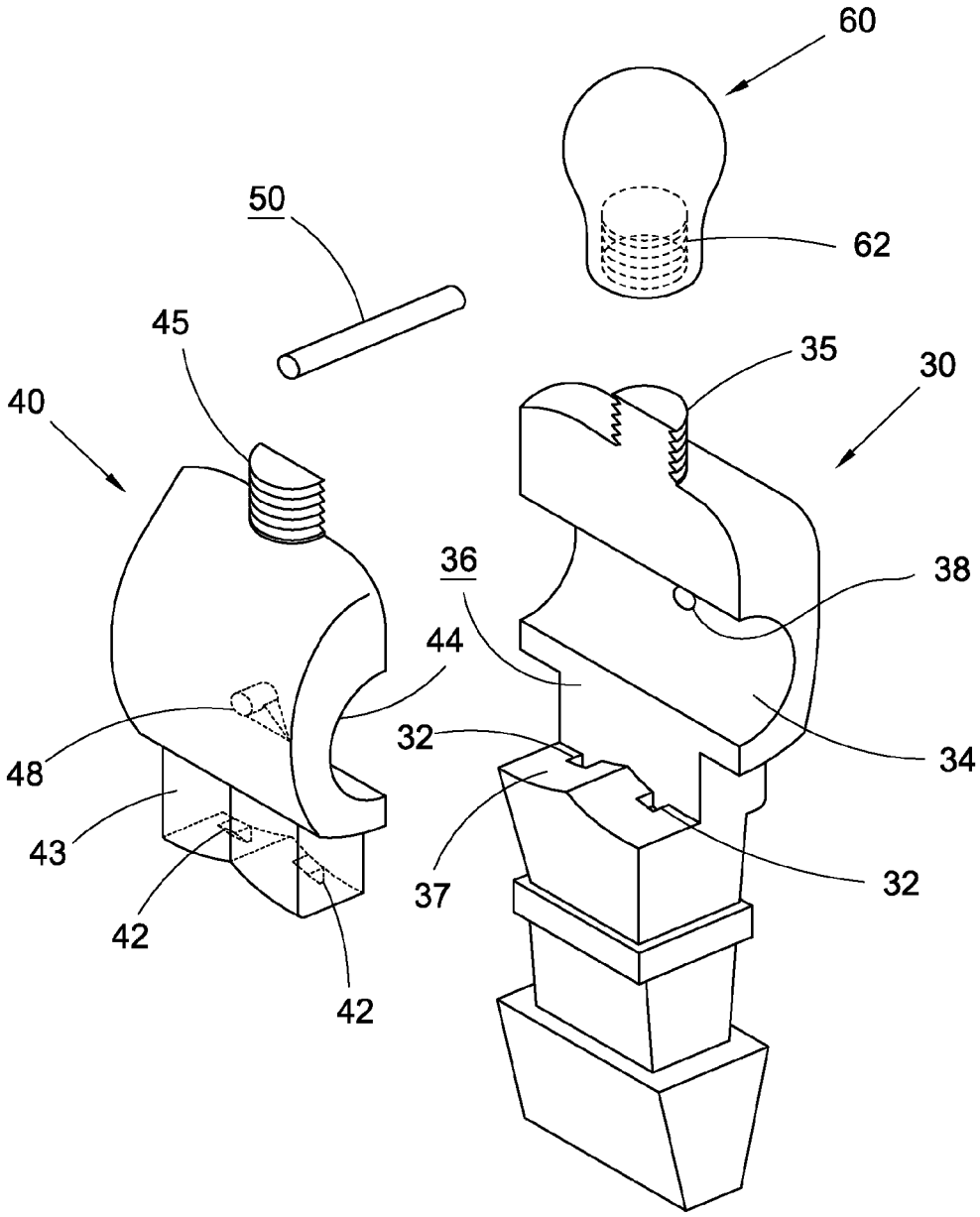
FIG. 3 is a perspective exploded view of FIG. 2.

Please refer to FIGS. 2 and 3. The first embodiment of the doll 20 of the present invention includes a first main body 30, a second main body 40, at least one fixing member 50 and a connecting member 60. The doll 20 has a middle body portion 22. Bottom ends of the first and second main bodies 30, 40 are latched with each other and an adjoining section, where the first and second main bodies 30, 40 contact to each other, is defined. A through hole 28 is formed through the adjoining section at the middle body portion 22. The through hole 28 passes through the doll from one side to the other side. The connecting member 60 connects top ends of the two main bodies 30, 40 and keeps the top ends closed. The structure of the doll will be described in more detail hereinafter.

The front face of the first main body 30 is formed with a latched section 32 and a first recess 34. The first recess 34 is formed at the middle portion of the first main body 30 from one side to the other. The latched section 32 is positioned at the bottom end of the first main body, 30. A connecting section 35 is formed at the top end of the first main body. To speak more detailedly, the front face of the first main body 30 is recessed to form a space 36, which defines a bottom wall 37 in accordance with the bottom end of the first main body 30, and a first wall face in conjunction with the first recess 34. The latched section 32 is formed on the bottom wall 37 of the space 36. In this embodiment, the latched section 32 is composed of a predetermined number of dents; however, this is not limited. The first recess 34 is positioned over the wall face of the space 36. A thread is formed on a circumference of the connecting section 35.

The second main body 40 is formed with a latching section 42 and a second recess 44. The second recess 44 is formed on a back face of the middle portion of the second main body 40. The latching section 42 is positioned at the bottom end of the second main body 40 and extends downwardly from a bottom face of the second main body 40. To speak more detailedly, the size of the second main body 40 is smaller than that of the first main body 30, so that the second main body 40 is adapted to accommodate in the space 36. The latching section 42 is composed of a predetermined number of insertion blocks, however, this is not limited. A connecting section 45 is formed at the top end of the second main body 40. A thread is formed on a circumference of the connecting section 45.

In this embodiment, the bottom face of the second main body 40 is formed below an extension lower portion 43, and the bottom face fits to mate the bottom wall 37 of the first main body 30. In practice, the bottom face defines two curved faces jointed together and being symmetrical, and the latching section 42 is arranged to the bottom face. The extension lower portion 43 defines a second wall face facing to contact the first wall face of the first main body 30.

The latching section 42 of the second main body 40 is latched with the latched section 32 of the first main body 30 to latch the two main bodies 30, 40 with each other. In latched state, the two recesses 34, 44 face each other to together form the through hole 28. Each of the recesses 34, 44 has a semi-circular or polygonal cross-section, whereby the through hole 28 has a circular or polygonal (such as rectangular) cross-section.

In this embodiment, the fixing member 50 is a pin. In practice, the two main bodies can be made by means of injection molding. After molded, one end of the pin 50 can be fixed with one of the main bodies 30, 40 in the recess 34 or 44. Alternatively, the pin 50 is not previously fixed with any main body. When assembled, the pin is fixed with the main bodies by way of insertion. In this case, the wall faces of the recesses 35, 45 are formed with insertion holes 38, 48 for inserting two ends of the pin therein.

Figure 4:
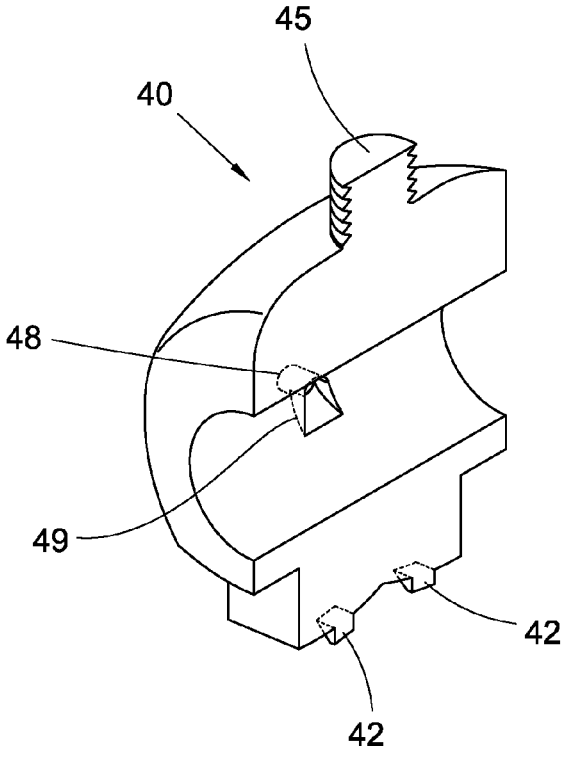
FIG. 4 is a perspective enlarged view of a second main body from another angle according to the first embodiment of the present invention.
Figure 5:
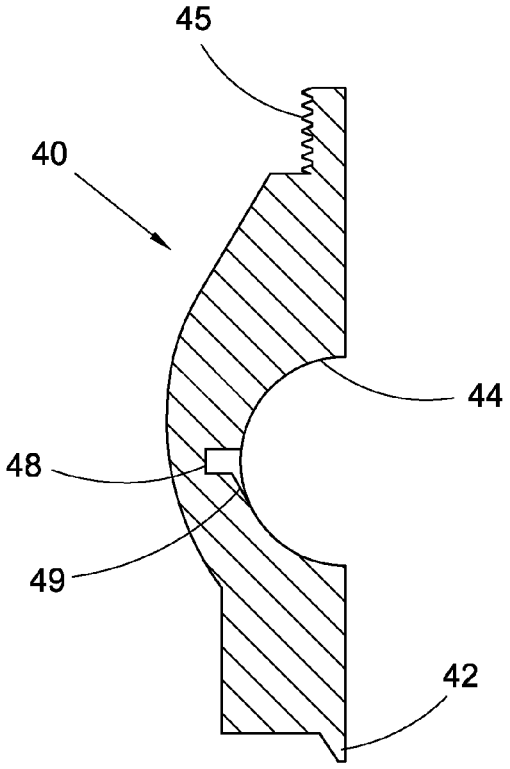
FIG. 5 is a sectional assembled view of FIG. 4.

Referring to FIGS. 4 and 5, the second main body 40 further defines a guiding notch 49 communicating with the insertion hole 48 and the second recess 44. The guiding notch 49 is formed under the insertion hole 48. The configuration of the guiding notch 49 starts preferably from a center diameter of the insertion hole 48, so as to allow the fixing member 50 glide into the insertion hole 48. The guiding notch 49 extends downwardly and tilts at an inclined angle toward the second recess 44. Moreover, the guiding notch 49 defines a bottom side being wider than a top side, which is appropriately not smaller than the size of fixing member 50 for gliding. The top side of guiding notch 49 preferably equals to a diameter of the insertion hole 48.

Figure 6:
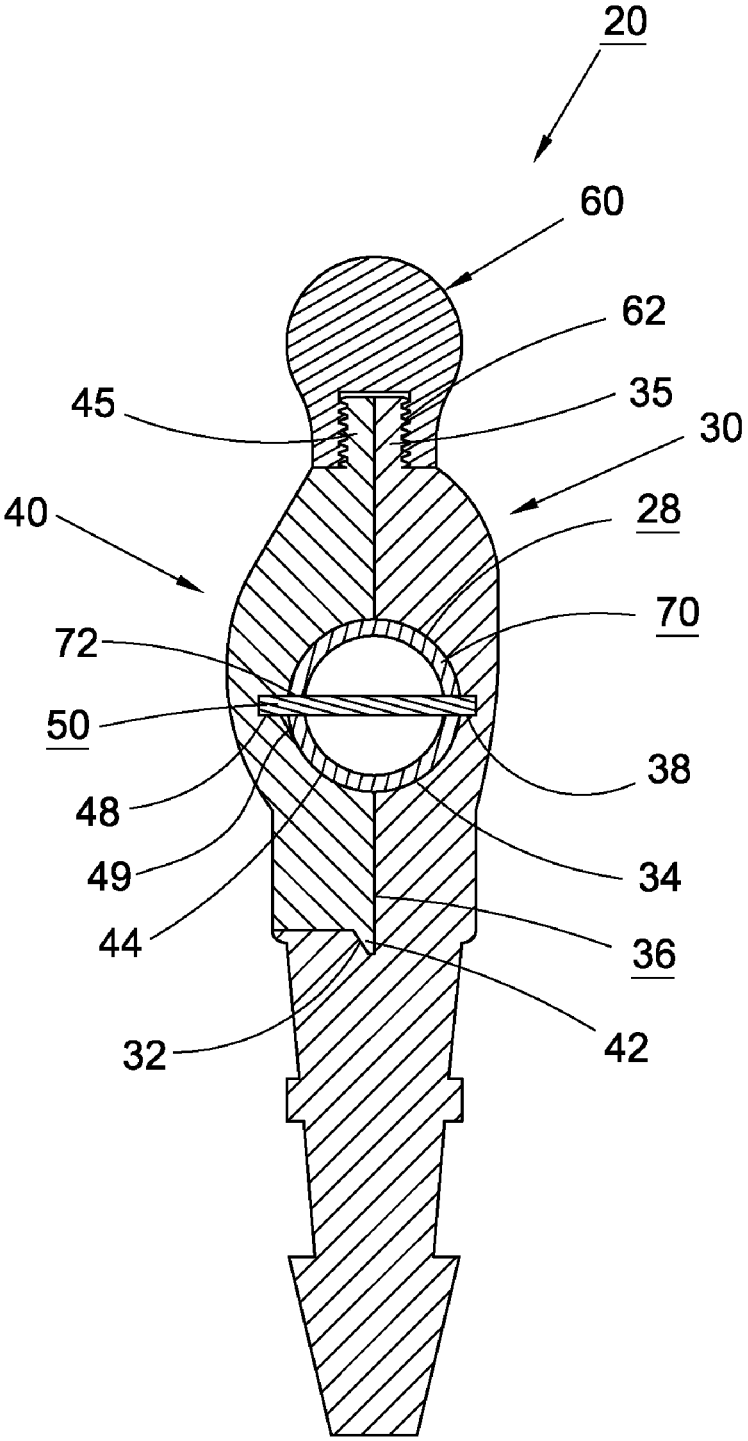
FIG. 6 is a sectional assembled view of the first embodiment of the doll of the present invention, in which the doll is mounted on an operation rod.

Referring to FIG. 6, the two main bodies 30, 40 are latched and mated with each other to hold an operation rod 70 which is positioned in the through hole 28. The fixing member 50 is inserted through the operation rod 70 to engage at least one of the main bodies 30, 40 with the operation rod 70.

A bottom interior face of the connecting member 60 is formed with a thread hole 62 in which the top ends of the two main bodies are screwed.

The doll is mounted on the operation rod 70 which is drilled with several perforations 72 for the fixing member 50 inserting.

Referring to FIG. 6, when installed the doll 20 on the operation rod, the first recess 34 of the first main body 30 is first fitted on the operation rod 70. The pin 50 is passed through the perforation 72 with one end of the pin 50 inserted in the insertion hole 38 of the first recess 34 of the first main body 30. Then, the latching section 42 of the second main body 40 is latched with the latched section 32 of the first main body 30, whereby the bottom ends of the two main bodies are latched and connected with each other. In the mean time, the other end of the pin 50 abuts against the guiding notch 49 and approaches to the top side from the bottom side thereof. Until the other end of the pin 50 passes over the guiding notch 49 and inserts into the insertion hole 48, the second main body 40 is mated with the first main body 30 to fit the second recess 44 onto the operation rod 70. Under such circumstance, the two connecting sections 35, 45 are side by side adjacent to each other. At this time, the second main body 40 is accommodated in the space 36 of the first main body 30. Finally, the thread hole 62 of the connecting member 60 is screwed on the connecting sections 35, 45 of the two main bodies to fix the top ends of the main bodies together. After connected, the operation rod 70 is held in the through hole 28 and the pin 50 passes through the perforation 72 of the operation rod with two ends of the pin 50 respectively inserted in the insertion holes 38, 48 of the recesses 34, 44. The pin 50 is not exposed to outer side of the main bodies, which results to a tidy appearance.

In this embodiment, the bottom face of the second main body 40 is formed below the second recess 43, and the bottom face fits to mate the bottom wall 37 of the first main body 30. In practice, the latching section 42 extends from the bottom face to latch and mate with the latched section 32 of the first main body 30; while the second main body 40 defines a second wall face facing to contact the first wall face of the first main body 30.

After assembled, the two main bodies 30, 40 of the doll 20 are connected with each other to hold the operation rod 70. The fixing member 50 engages the two main bodies with the operation rod, whereby the doll 20 is firmly connected with the operation rod 70 without possibility of moving relative to the operation rod. Accordingly, when operating the operation rod, the doll is driven to move or rotate.

In case of damage of the doll, have the connecting member 60 unscrewed from the two connecting sections 35, 45 and the latching section 42 of the second main body unlatched from the latched section 32 of the first main body. At this time, the two main bodies can be separated to take off the doll from the operation rod. Then a new doll can be mounted on the operation rod in the above manner instead of the damaged one. Accordingly, the doll can be easily replaced.

Figure 7:
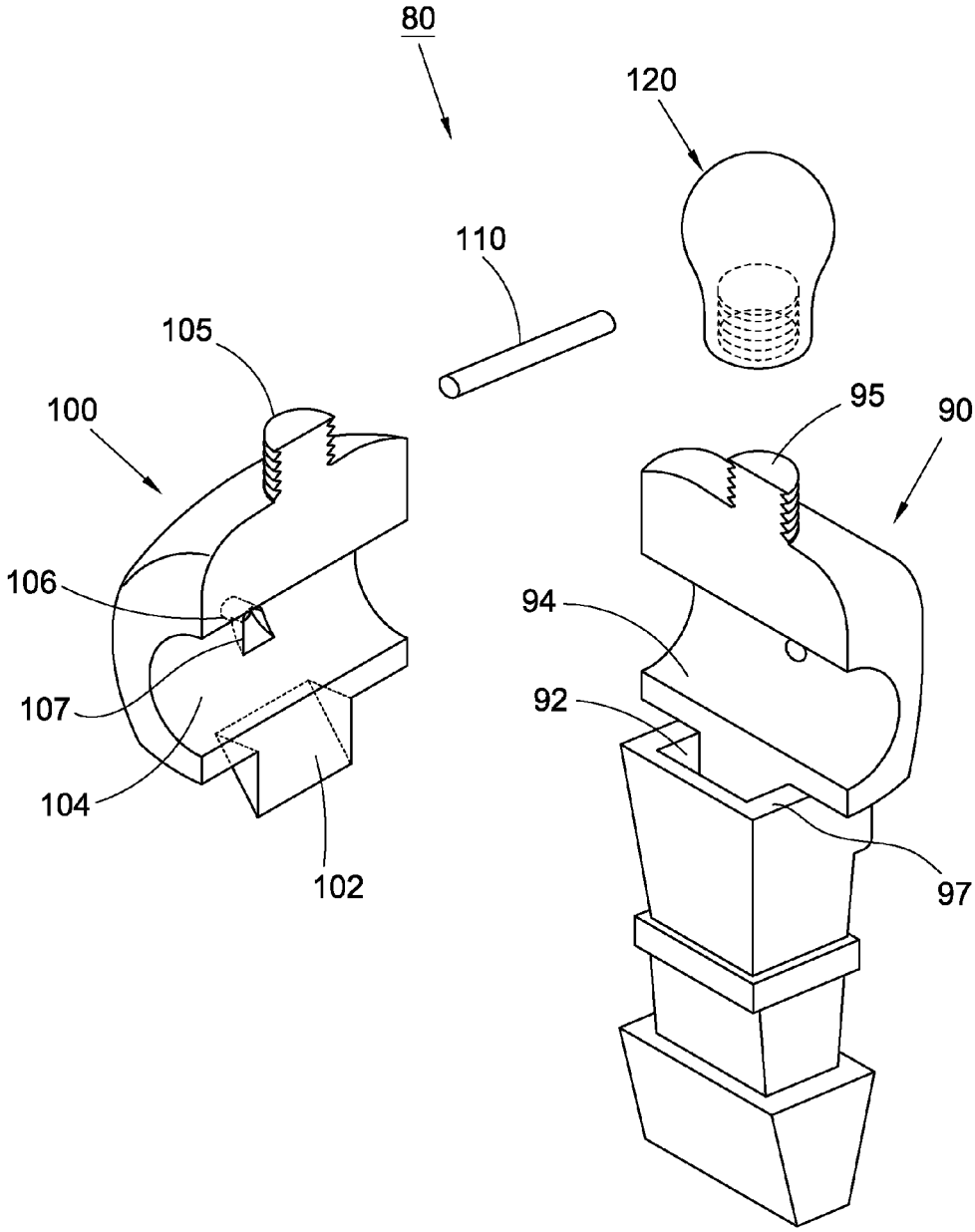
FIG. 7 is a perspective exploded view of a second embodiment of the doll of the present invention.
Figure 8:
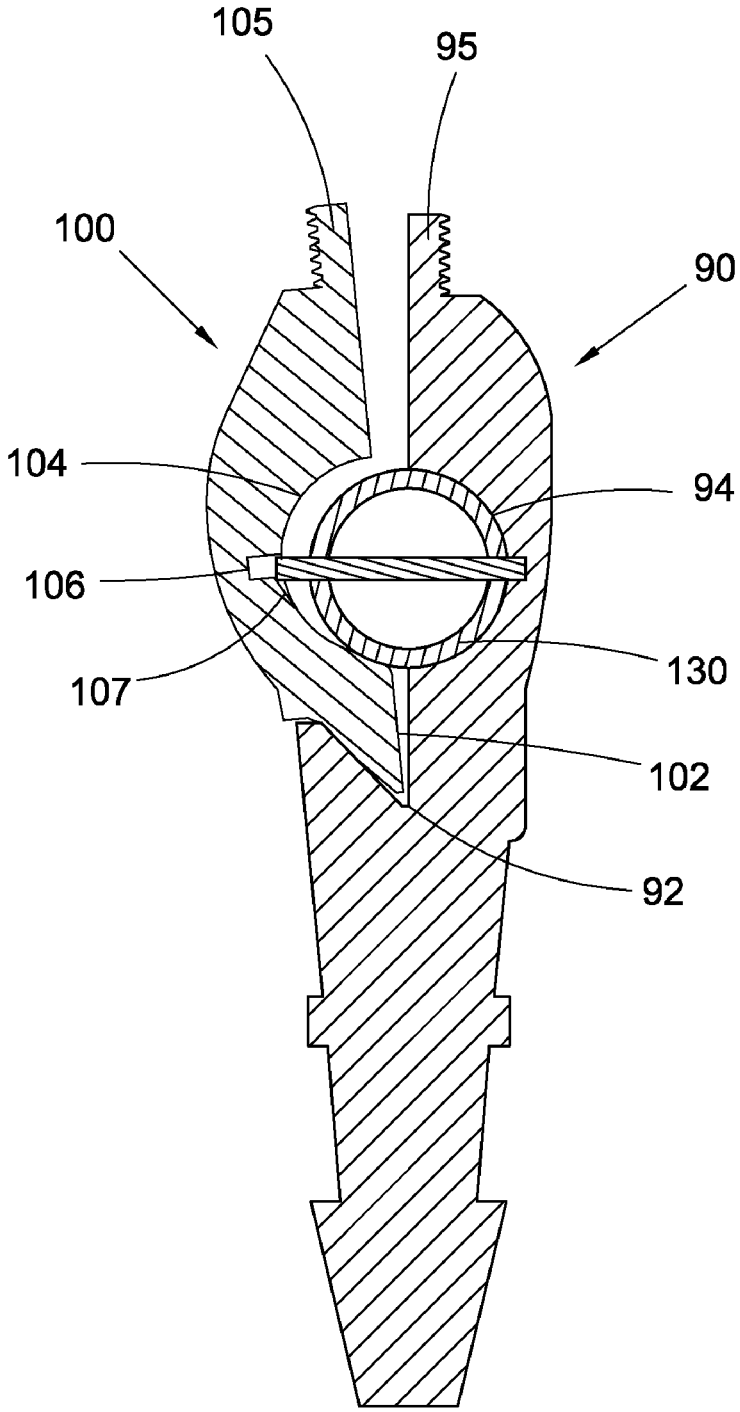
FIG. 8 is a sectional view of the second embodiment of the doll of the present invention in assembling process, in which the doll is mounted on an operation rod.

FIGS. 7 and 8 show a second embodiment of the doll 80 of the present invention, which includes a first main body 90, a second main body 100, a fixing member 110 and a connecting member 120. The fixing member 110, the recesses 94, 104 and the connecting sections 95, 105 of the bodies 90, 100 as well as the connecting member 120 are identical to those of the first embodiment. Therefore, these parts will not be repeatedly described hereinafter.

In the second embodiment, the quantity of the latching section 102 and the latched section 92 is merely one corresponding to each other, and the size of the latched section 92 is appropriately near that of the bottom wall 97 of the first main body 90. Preferably, one end of the fixing member is integrally formed with the first main body 90. The other end of the fixing member 110 abuts against a guiding notch 107 and approaches to the top side from the bottom side thereof. Until the other end of the fixing member 50 passes over the guiding notch 107 and inserts into the insertion hole 106, the two main bodies 90, 100 are connected with each other in the same manner as the first embodiment. The doll 80 is fitted on an operation rod 130 with the fixing members 110 engaged therein. Accordingly, the two main bodies 90, 100 can be firmly associated with the operation rod 130.

The main bodies are detachably assembled so that the doll of the present invention is detachably mounted on the operation rod, which can be easily installed, disassembled and replaced. When replaced, it is unnecessary to troublesomely detach the operation rod from the football game table. In addition, in practice, the fixing member is hidden in the doll without being exposed to outer side so that the doll has a beautiful tidy appearance.

The above embodiments are only used to illustrate the present invention, not intended to limit the scope thereof. Many modifications of the above embodiments can be made without departing from the spirit of the present invention.

What is claimed is:

1. A doll of football game table for mounting on an operation rod of the football game table, comprising:

a first main body having a latched section and a first recess, the latched section being formed at a bottom end of the first main body; the first recess being formed on a front face of the first main body between two ends thereof, the first recess passing through the first main body from one side to the other;

a second main body having a latching section, a second recess, an insertion hole and a guiding notch, the latching section being formed at a bottom end of the second main body; the second recess being formed on a back face of the second main body between two ends thereof, the second recess passing through the second main body from one side to the other; the insertion hole being formed on the back face thereof to communicate with the second recess; the guiding notch being formed on the back face thereof to communicate with the insertion hole and the recess; the guiding notch starting from the insertion hole, and extending downwardly and tilting at an inclined angle toward the second recess; the latching section of the second main body being latched with the latched section of the first main body to detachably latch the bottom ends of the first and second main bodies with each other; in a mating state, the two recesses of the main bodies facing each other together to form a through hole; each of the main bodies having a top end, the top ends of the main bodies corresponding to each other; a connecting section being protrusively formed at each of the top ends of the main body;

a fixing member positioned in the through hole and connected with the recesses; the fixing member serving to engage at the two main bodies with the operation rod;

a connecting member detachably connecting the top ends of the main bodies with each other; whereby the two main bodies being connected with each other to hold the operation rod; a bottom interior face of the connecting member being formed with a thread hole; and a thread being formed on a circumference of each connecting section, whereby the connecting sections of the top ends of the main bodies are screwed into the thread hole of the connecting member; wherein the front face of the first main body is recessed to form a space; the space defines a bottom wall in accordance with the bottom end of the first main body; the latched section is formed on the bottom wall of the space;

the first recess is formed on the front face of the first main body and positioned over the space, and the second main body is accommodated in the space;

the latching section extends downwardly from a bottom face of the second main body; and the bottom face of the second main body mates the bottom wall of the first main body;

whereby the fixing member passes through the operation rod for holding the operation rod, and defines an end secured to the first main body and the other end abutting against the guiding notch; until the other end of the fixing end approaches the insertion hole for securing the fixing member, the second main body mates with the first main body.

2. The doll of football game table for mounting on an operation rod of the football game table as claimed in claim 1, wherein the bottom face of the second main body is formed below an extension lower portion thereof.

3. The doll of football game table for mounting on an operation rod of the football game table as claimed in claim 2, wherein the bottom face defines two curved faces jointed together and being symmetrical, and the latching section is arranged to the bottom face; the latching section of the second main body is composed of a predetermined number of insertion blocks, while the latched section of the first main body is composed of a predetermined number of dents.

4. The doll of football game table for mounting on an operation rod of the football game table as claimed in claim 2, wherein the latching section of the second main body extends from the bottom face of the extension lower portion to latch and mate with the latched section of the first main body; the second main body defines a second wall face facing to contact a first wall face of the first main body.

5. The doll of football game table for mounting on an operation rod of the football game table as claimed in claim 1, wherein the latching section of the second main body extends from the bottom face to latch and mate with the latched section of the first main body; the second main body defines a second wall face facing to contact a first wall face of the first main body.

6. The doll of football game table for mounting on an operation rod of the football game table as claimed in claim 1, wherein the guiding notch defines a bottom side being wider than a top side, which is appropriately not smaller than the size of fixing member.

7. The doll of football game table for mounting on an operation rod of the football game table as claimed in claim 6, wherein the top side of the guiding notch appropriately equals to the center diameter of the insertion hole of the second main body.

8. The doll of football game table for mounting on an operation rod of the football game table as claimed in claim 2, wherein the guiding notch defines a bottom side being wider than a top side, which is appropriately not smaller than the size of fixing member.

9. The doll of football game table for mounting on an operation rod of the football game table as claimed in claim 8, wherein the top side of the guiding notch appropriately equals to the center diameter of the insertion hole of the second main body.

10. The doll of football game table for mounting on an operation rod of the football game table as claimed in claim 3, wherein the guiding notch defines a bottom side being wider than a top side, which is appropriately not smaller than the size of fixing member.

11. The doll of football game table for mounting on an operation rod of the football game table as claimed in claim 10, wherein the top side of the guiding notch appropriately equals to the center diameter of the insertion hole of the second main body.

12. The doll of football game table for mounting on an operation rod of the football game table as claimed in claim 4, wherein the guiding notch defines a bottom side being wider than a top side, which is appropriately not smaller than the size of fixing member.

13. The doll of football game table for mounting on an operation rod of the football game table as claimed in claim

12, wherein the top side of the guiding notch appropriately equals to the center diameter of the insertion hole of the second main body.

14. The doll of football game table for mounting on an operation rod of the football game table as claimed in claim 5, wherein the guiding notch defines a bottom side being wider than a top side, which is appropriately not smaller than the size of fixing member.

15. The doll of football game table for mounting on an operation rod of the football game table as claimed in claim 14, wherein the top side of the guiding notch appropriately equals to the center diameter of the insertion hole of the second main body.

16. The doll of football game table for mounting on an operation rod of the football game table as claimed in claim 1, wherein the size of the latched section is appropriately near that of the bottom wall of the first main body; while the configuration and size of the latching section of the second main body correspond to the latched section of the first main body.

17. The doll of football game table for mounting on an operation rod of the football game table as claimed in claim 5, wherein the latching section of the second main body extends from the bottom face to latch and mate with the latched section of the first main body; the second main body defines a second wall face facing to contact a first wall face of the first main body.

18. The doll of football game table for mounting on an operation rod of the football game table as claimed in claim 14, wherein the latching section of the second main body extends from the bottom face to latch and mate with the latched section of the first main body; the second main body defines a second wall face facing to contact a first wall face of the first main body.

19. The doll of football game table for mounting on an operation rod of the football game table as claimed in claim 15, wherein the latching section of the second main body extends from the bottom face to latch and mate with the latched section of the first main body; the second main body defines a second wall face facing to contact a first wall face of the first main body.

* * * * *